United States Patent [19]

Jenkins

[11] 3,941,289

[45] Mar. 2, 1976

[54] LABEL PRINTING AND APPLYING APPARATUS

[75] Inventor: William A. Jenkins, Englewood, Ohio

[73] Assignee: Monarch Marking Systems, Inc., Dayton, Ohio

[22] Filed: June 3, 1974

[21] Appl. No.: 475,730

Related U.S. Application Data

[60] Division of Ser. No. 366,919, June 4, 1973, which is a division of Ser. No. 206,061, Dec. 8, 1971, Pat. No. 3,783,083, which is a continuation-in-part of Ser. No. 155,740, June 23, 1971, abandoned.

[52] U.S. Cl. ..... 226/76; 226/129; 226/139; 226/157

[51] Int. Cl.[2] ..... B65H 17/22

[58] Field of Search ..... 226/157, 137, 138, 139, 226/156, 174, 76, 129; 74/577 M; 64/9 R, 14

[56] References Cited

UNITED STATES PATENTS

| | | | |
|---|---|---|---|
| 1,455,425 | 5/1923 | Brown | 64/14 |
| 1,693,092 | 11/1928 | Mason | 226/157 |
| 3,381,496 | 5/1968 | Nash | 64/9 R X |
| 3,606,125 | 9/1971 | Tucker | 226/157 X |

*Primary Examiner*—Richard A. Schacher
*Attorney, Agent, or Firm*—Joseph J. Grass

[57] ABSTRACT

There are disclosed various embodiments of a composite web of pressure sensitive labels, method and apparatus for making such embodiments of the composite web, and method and apparatus by which a composite web of labels is advanced and by which labels are successively printed and applied to merchandise.

16 Claims, 24 Drawing Figures

FIG-1
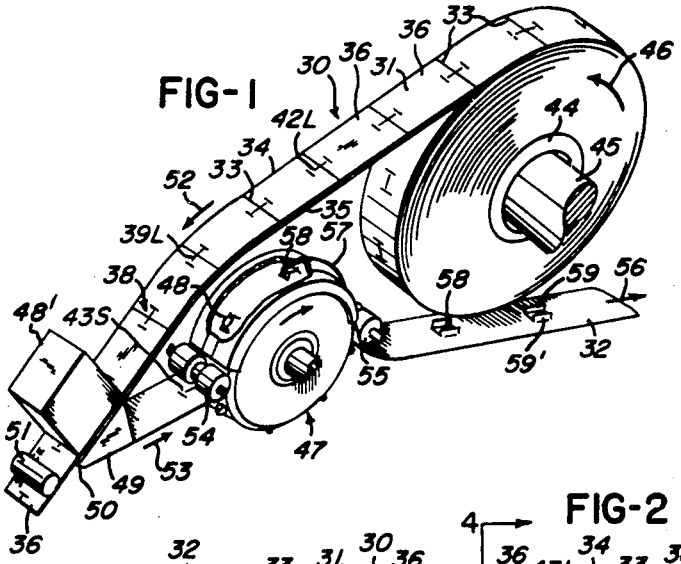
FIG-2
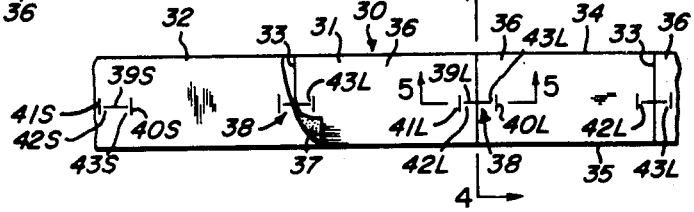
FIG-3
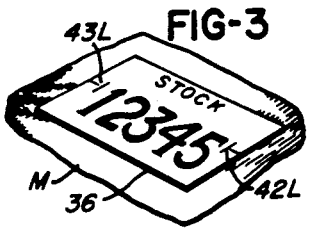
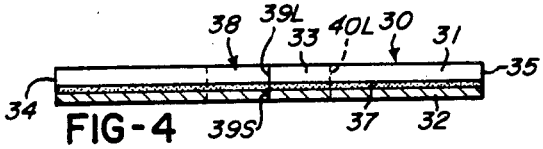
FIG-4
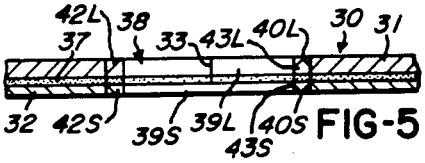
FIG-5
FIG-7
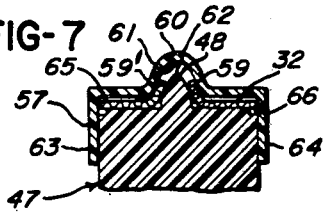
FIG-6
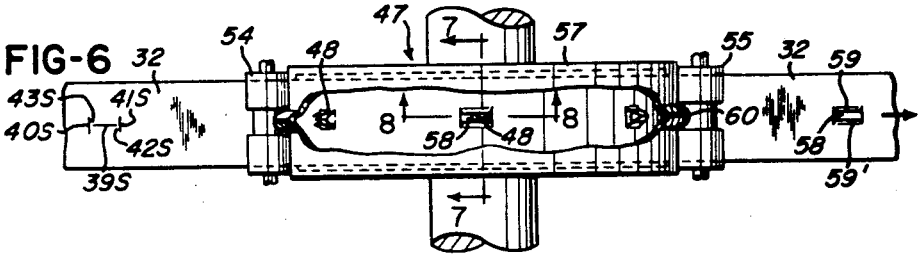

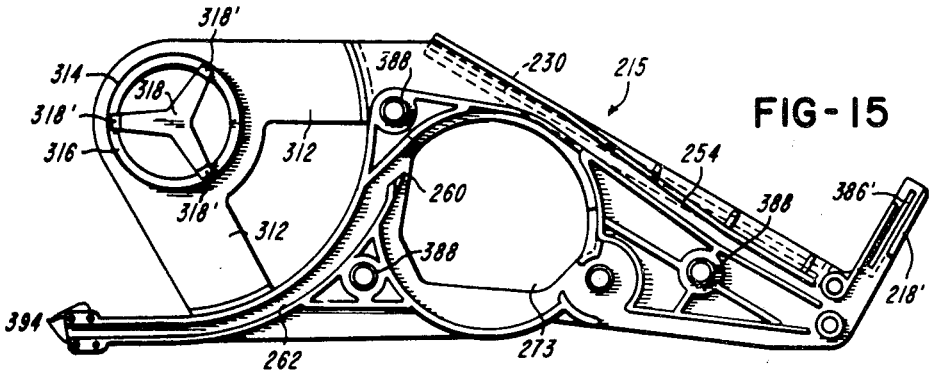
FIG-15
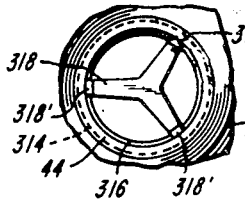
FIG-17
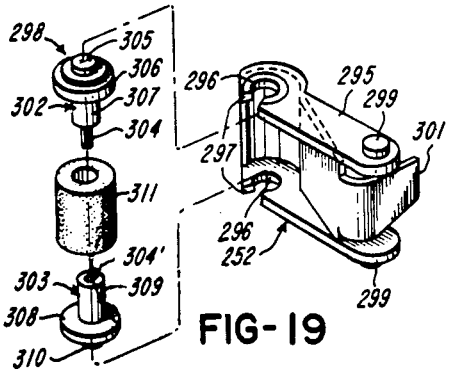
FIG-19
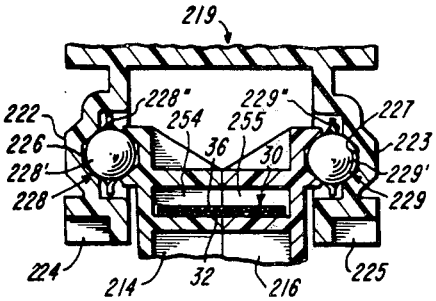
FIG-18
FIG-20
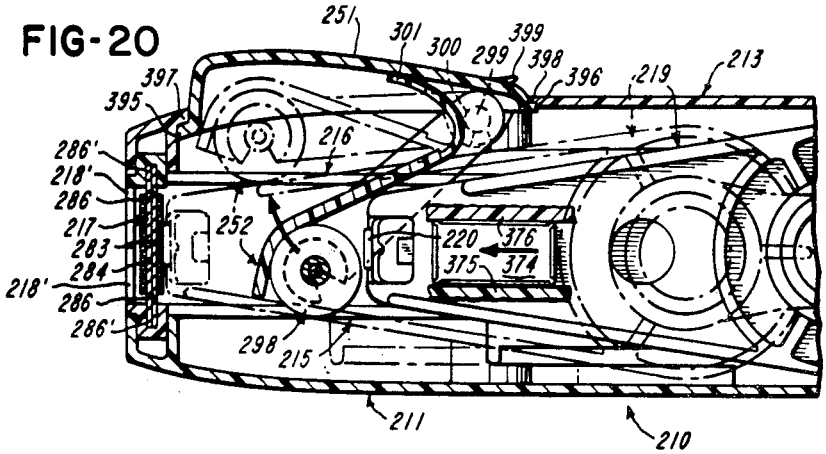

FIG-21
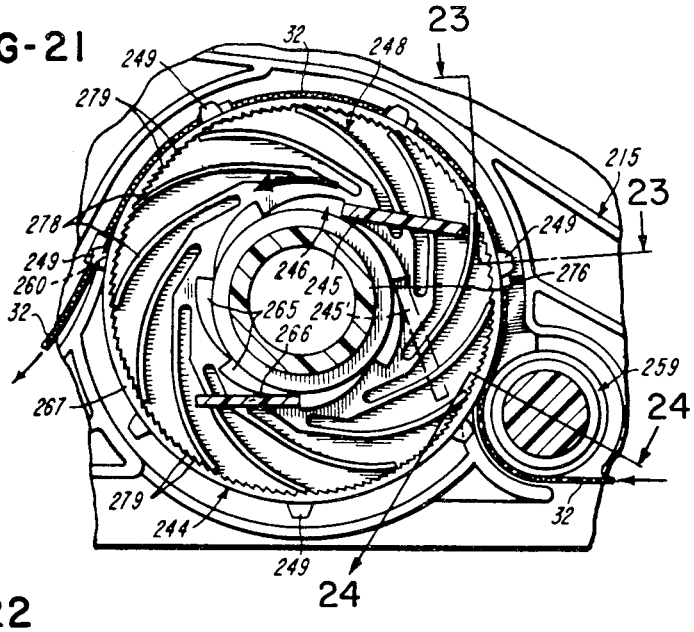
FIG-22
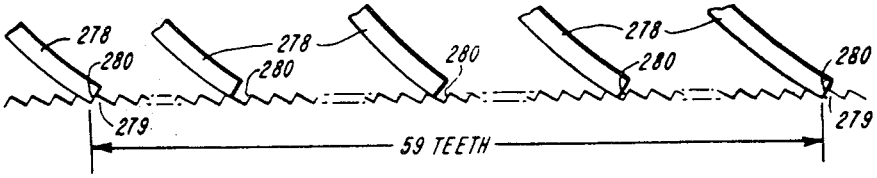
FIG-24
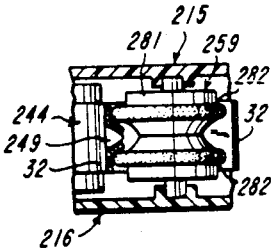
FIG-16
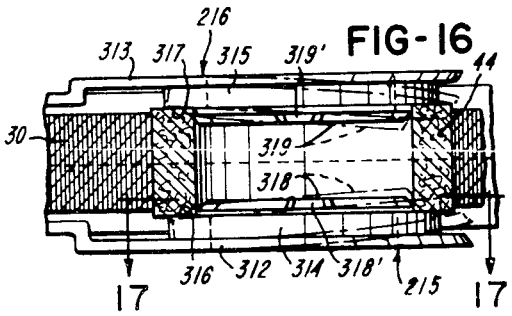
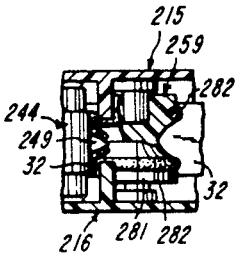
FIG-23

LABEL PRINTING AND APPLYING APPARATUS

CROSS-REFERENCE TO RELATED APPLICATIONS

This is a division of copending U.S. patent application Ser. No. 366,919, filed June 4, 1973, which is a division of copending U.S. application Ser. No. 206,061, filed Dec. 8, 1971, now U.S. Pat. No. 3,783,083, which is a continuation-in-part of copending U.S. patent application Ser. No. 155,740, filed June 23, 1971, now abandoned.

Certain subject matter disclosed in the present application is claimed in copending U.S. application Ser. No. 205,854, filed Dec. 8, 1971, now U.S. Pat. No. 3,798,106, copending U.S. application Ser. No. 208,035, filed Dec. 8, 1971, now abandoned, U.S. Ser. No. 475,728 filed June 3, 1974 and U.S. application Ser. No. 508,932 filed Sept. 30, 1974, and which are assigned to the same assignee as the present application.

BACKGROUND OF THE INVENTION

1. Field of the Invention

This invention relates to the art of pressure sensitive labels, method and apparatus for making and using same, and label printing and applying machines.

2. Brief Description of the Prior Art

Various U.S. Pat. Nos. 1,642,387, 2,259,358, 2,275,064, 2,502,257, 2,516,487, 2,620,205, 2,656,063, 3,051,353, 3,265,553, 3,343,485, 3,440,123, 3,501,365, 3,551,251, and 3,611,929 and British pat. No. 1,057,126, Feb. 1, 1967 are made of record.

SUMMARY OF THE INVENTION

This invention relates to a web feeding apparatus which is compact and which adapts itself well for use in a hand-held apparatus. In accordance with the invention, the relative position of a ratchet wheel with respect to a feed wheel can be selectively varied manually. The driving means for the feed wheel preferably comprises the ratchet wheel, a driven gear mounted coaxially with respect to the feed wheel, a pawl carried by the driven gear and cooperable with the ratchet wheel, a drive gear in driving engagement with the driven gear, and means for alternately rotating the drive gear in one direction and thereafter in the opposite direction. The means for varying the position of the ratchet wheel relative to the feed wheel preferably includes a driven member secured to the feed wheel and having a plurality of spaced-apart teeth and a driving member having a plurality of pawls engaged with less than the total number of teeth. The pawls are arranged against the teeth to normally prevent rotation of the driving member relative to the driven member in either the driving direction or the non-driving direction and a pair of knobs for manually rotating the driving member in the non-driving direction relative to the driven member.

BRIEF DESCRIPTION OF THE DRAWINGS

FIG. 1 is a perspective view showing method and apparatus by which one embodiment of a composite web of labels is advanced and by which labels are successively printed and applied to merchandise;

FIG. 2 is a top plan view of the composite web of labels shown in FIG. 1;

FIG. 3 is a perspective view of one of the labels, shown in FIGS. 1 and 2, applied to merchandise;

FIG. 4 is a sectional view taken along line 4—4 of FIG. 2;

FIG. 5 is a sectional view taken along line 5—5 of FIG. 2;

FIG. 6 is a top plan view showing the composite web being advanced by a toothed driver with the web of supporting material;

FIG. 7 is a sectional view taken along line 7—7 of FIG. 6;

FIG. 15 is a side elevational view of the other subframe section;

FIG. 16 is a top plan view showing the manner in which the label core for the roll of labels is held and the manner in which braking force is applied by the subframe sections;

FIG. 17 is a sectional view taken along line 17—17 of FIG. 16;

FIG. 18 is a sectional view taken generally along line 18—18 of FIG. 9;

FIG. 19 is an exploded perspective view of the inking mechanism;

FIG. 20 is an enlarged sectional view showing a fragmentary portion of the apparatus in solid lines, and in particular showing a fragmentary portion of the print head and the inking mechanism in both solid and phantom line positions;

FIG. 21 is a sectional view taken along line 21—21 of FIG. 10;

FIG. 22 is a developed view showing the arrangement of the teeth of the detent mechanism;

FIG. 23 is a sectional view taken along line 23—23 of FIG. 21; and

FIG. 24 is a sectional view taken generally along line 24—24 of FIG. 21.

DESCRIPTION OF THE PREFERRED EMBODIMENTS

Figure 8:
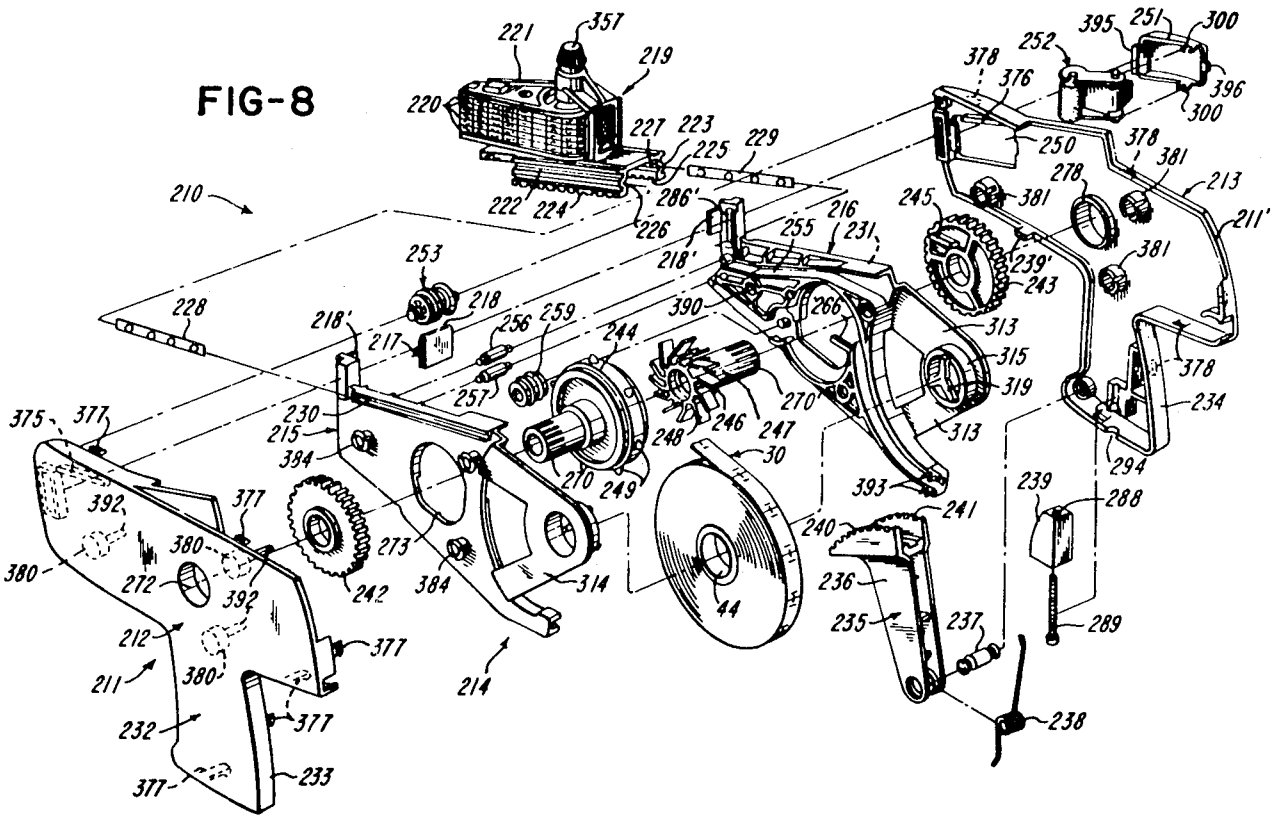
FIG. 8 is an exploded perspective view of label printing and applying apparatus for carrying out the method of the invention.

Referring to the embodiment of FIGS. 1 through 6, and in particular to FIGS. 2, 3 and 4, there is shown a composite web 30 of label material 31 releasably adhered to and carried by supporting or backing material 32. The label material 31 is cut transversely by transverse cuts 33 extending all the way across the web 31 of label material to the side edges 34 and 35 of the composite web 30, as best shown in FIGS. 2 and 4. The cuts 33 known as "butt cuts" separate the web 31 of label material into a series of end-to-end labels 36. The side edges of the label material as well as the supporting material are straight and the label material is coextensive with the supporting material.

The underside of the web 31 of label material has a coating of pressure sensitive adhesive 37 which adheres strongly to the web 31 of label material. The adhesive is shown to extend across the entire underside of the label material even to the side edges 34 and 35 of the web 30. The web 32 of supporting material carries a thin film or coating (not shown) which allows the labels to be peeled from the web 32 of supporting material.

Groups 38 of cuts are provided at equally spaced apart intervals along the length of the composite web 30. Each group 38 of cuts is shown to extend through the supporting material as well as through the label material. Each group 38 of cuts is shown to be made in a generally I-shaped configuration comprised of a straight longitudinal or vertical bar cut 39S in the supporting material and an aligned straight longitudinal or vertical bar cut 39L in the label material. Spaced from the one ends of the vertical bar cuts 39S and 39L are straight transverse or horizontal bar cuts 40S in the supporting material and 40L in the label material. Spaced from the other ends of the vertical bar cuts 39S and 39L are aligned straight transverse or horizontal bar cuts 41S in the supporting material and straight transverse or horizontal bar cuts 41L in the label material. The part of the web 32 between the one end of the cut 39S and the cut 40S provides a frangible portion 43S and the part of the web 32 between the other end of the cut 39S and the cut 41S provides a frangible portion 42S. In like manner, the part of the label material between the end of the cut 39L and the cut 40L provides a frangible portion 43L and the part between the other end of the cut 39L and the cut 41L provides a frangible portion 42L. As a variation of the illustrated groups 38 of cuts, the cuts 40L and 40S can be omitted in which event the cut 39S will be extended by tearing as the tooth 48 engages the web 32 at the cut 39S; this would result in groups of cuts each having a generally T-shaped configuration.

With reference now to FIG. 1, the composite web 30 is shown to be in the form of a roll which can be wound on a core 44, as desired. The core 44 can receive a shaft 45 about which the roll is free to rotate in the direction of arrow 46. The roll is wound in such a manner that the label material is on the outside in overlying relationship with respect to the web 32 of supporting material.

A toothed driver generally indicated at 47 is shown to be in the form of a driven sprocket having teeth 48 disposed in a plane at equally spaced apart angular positions around the circumference of the driver 47. The driver 47 is used to advance the composite web first to a printing zone at which a printer 48' and a platen 49 are disposed. A relatively sharp peel edge 50 is diagrammatically illustrated as being disposed at the terminal end of the platen. The web of supporting material 32 is drawn around the peel edge 50 by the toothed driver 47. The edge 50 causes the supporting material 32 to make an abrupt change in direction, thereby effecting delamination or peeling of the supporting material 32 from one label 36 at a time as the web of supporting material is concomitantly advanced by the toothed driver 47. An applicator 51 is positioned beyond the peel edge 50 and on the same side of the label as the printer 48'. The applicator 51 is shown to take the form of a conventional applicator roll, however, other types of applicators such as a plunger, a presser foot, or the like can be used, if desired. The composite web 30 approaches the printing and applying zones generally in the direction of an arrow 52, and after passing around the peel edge 50 the web 32 of supporting material advances generally in the direction of arrow 53 and passes partially around a guide roller or shaft 54. From the guide roller 54, the web 32 passes partially around the toothed driver 47. From there the web 32 passes partially around a guide roller or shaft 55 and from there the web 32 is guided by means of guides in the direction of the arrow 56. The toothed driver 47 is driven stepwise by a pawl and ratchet mechanism so that upon operation of this mechanism the composite web 30 is advanced through the appropriate distance so that the labels can be printed at one or more stages and so that a label is brought to the applying zone at which the applicator 51 is effective to apply the dispensed label to merchandise M. The web 32 passes between the outer surface of the toothed driver 47 and a guide or hold down plate 57 as shown in FIGS. 1, and 6. As the driver 47 rotates, successive teeth engage successive groups of cuts in the web 32. As a tooth engages the web 32 at a longitudinal cut 39S frangible portions 42S and 43S are severed as by tearing to provide a feed hole 58. The feed hole 58 thus formed receives the tooth 48 and deflects flaps 59 and 59'.

Referring now to a label printing and applying apparatus generally indicated at 210 in the embodiment of FIGS. 8 through 24, and initially to FIG. 8, there is shown to be a housing or main frame generally indicated at 211. The housing or frame 211 is specifically shown to include a pair of frame sections 212 and 213. Disposed within the housing 211 is a subframe generally indicated at 214 which comprises a pair of subframe sections 215 and 216. The frame sections 212 and 213 mount a platen 217 which includes a peel edge 218. A print head generally indicated at 219 is mounted by the subframe 214. More specifically, the print head 219 includes a plurality of selectable settable printing members 220 in the form of endless printing bands mounted by a print head frame 221. Extending from the frame 221 are a pair of flanges 222 and 223. Gear sections or specifically racks 224 and 225 are provided at the ends of the respective flanges 222 and 223. Opposed tracks 226 and 227 are formed on the respective flanges 222 and 223 to receive straight ball bearings 228 and 229. The subframe sections 215 and 216 have respective tracks 230 and 231. The ball bearing 228 is received in the track 226 of the flange 222 and in the track 230, and the ball bearing 229 is received in the track 227 in the flange 223 and in the track 231. The ball bearings 228 and 229 have respective balls 228' and 229' rotatably held by respective tangs or holders 228'' and 229''. In this manner, the print head 219 is mounted for movement, particularly reciprocating movement, toward and away from the platen 217.

The housing 211 has a handle generally indicated at 232 and particularly each housing or frame section 212 and 213 has a respective handle portion 233 and 234. An operator generally indicated at 235 is shown to comprise a pivotally operated lever 236 pivotally mounted by a post 237 at the lower end of the handle 232. The lever 236 is normally urged in a counterclockwise direction (FIG. 8) by a torsion spring 238 received about the post 237. The pivotal movement of the lever 236 is limited by an adjustable stop block 239 received by the handle 232 between the handle portions 233 and 234. The upper end of the operating lever 235 carries a pair of spaced-apart gear sections 240 and 241. The gear sections 240 and 241 are shown to be in the form of spur gear segments. Gear sections 240 and 241 are in meshing engagement with respective spur gears 242 and 243. The spur gears 242 and 243 are in meshing engagement with respective gear sections 224 and 225 carried by the print head 219.

A roll of pressure sensitive labels, in the form for example of the composite web 30 shown in FIG. 2, is mounted by its core 44 by the sub-frame 214. As will be described in greater detail hereinafter, the composite web 30 is drawn off the roll into overlying relationship with respect to the platen 217 and the supporting material 32 is engaged by a toothed driver 244. The gear 243 carries an integral pawl 245 cooperable with a ratchet wheel 246 which is coupled to the driver 244 by a detent mechanism generally indicated at 247. An input or drive member 248 of the detent mechanism 247 is shown in FIG. 8. The toothed driver 244 has a plurality of equally spaced apart drive teeth 249 arranged about its outer periphery. The pawl 245 is integrally joined at but one end to the gear 243. The pawl 245 is flexible and resilient and can ride on the ratchet wheel 246 and deflect into engagement with a tooth 265 of the ratchet wheel 246.

The housing or frame section 213 has an access opening 250. A cover 251 is removably connected to the frame section 213 at the access opening 250. The cover 251 mounts an inking mechanism 252 cooperable with the printing members 220 of the print head 219. The housing sections 212 and 213 mount an applicator 253 disposed downstream of the peel edge 218.

Figures 9, 10, 11, 12:
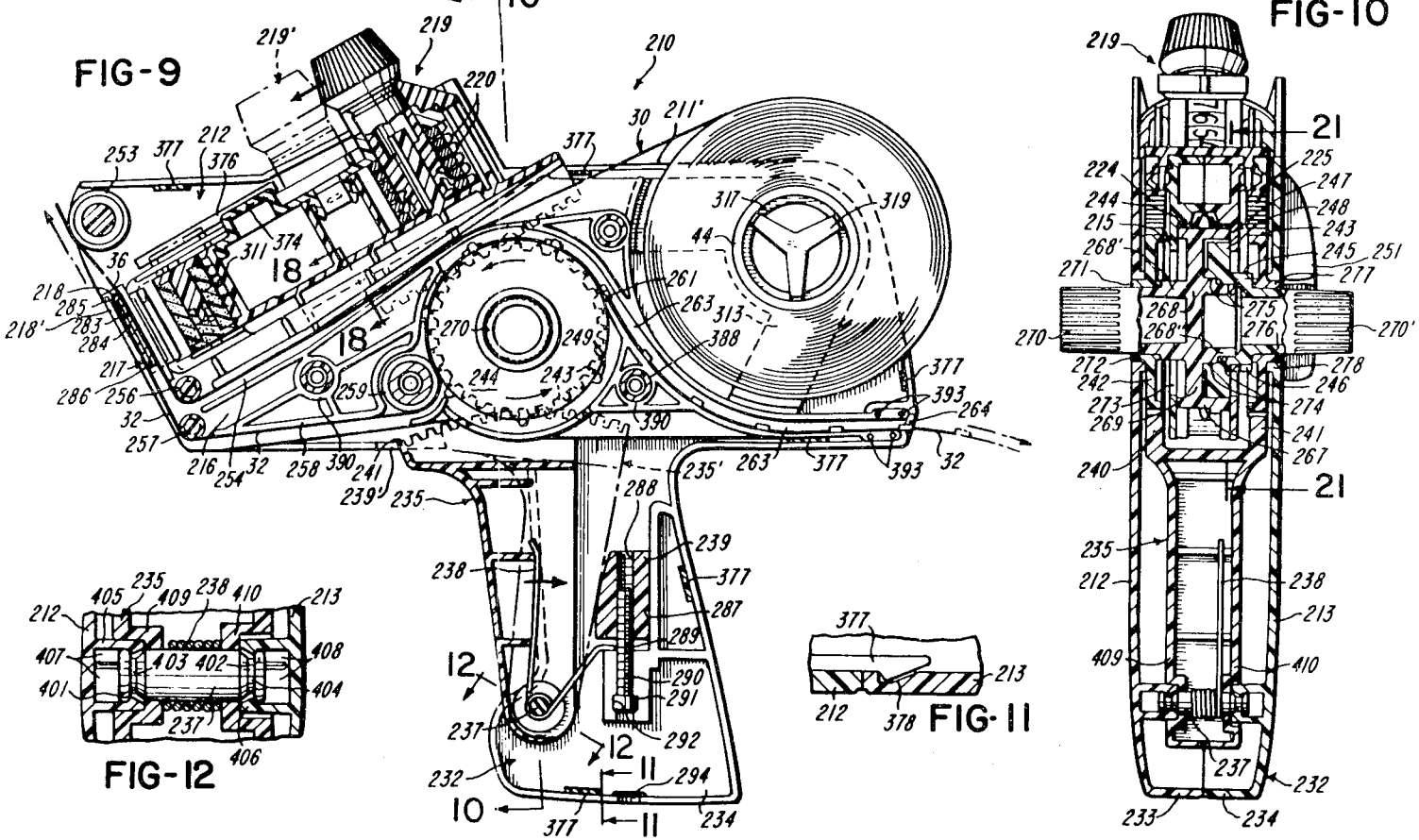
FIG. 9 is a sectional elevational view of the apparatus shown in FIG. 8.
FIG. 10 is a sectional view taken generally along line 10—10 of FIG. 9.
FIG. 11 is a sectional view taken along line 11—11 of FIG. 9.
FIG. 12 is a sectional view taken along line 12—12 of FIG. 9.

Referring to FIG. 9, the interrelationship of the components of the apparatus 210 is shown in detail. The composite web 30 is paid out of the roll and passes through a passage provided by subframe sections 215 and 216 and specifically by groove 254 (FIG. 15) in the subframe section 215 and a cooperating groove 255 (FIGS. 8, 9 and 13) in the subframe section 216. From there the composite web 30 passes partly around a roll 256 and into overlying relationship with the platen 217. Delamination is effected at the peel edge 218 formed at the end of the platen 217. The supporting material 32 is drawn around the peel edge 218 beneath the platen 217 and passes partly around a roll 257, below the guide 258 and between the toothed driver 244 and the mating die wheel 259. As a tooth 249 moves into mating cooperation with the die wheel 259, the tooth 249 engages the supporting material 32 at the longitudinal cut 39S and effects rupturing or bursting of the frangible portions 42S and 43S, whereupon the tooth 249 which is in mating cooperation with the die wheel 259 (FIG. 24) is considered to have formed a feed hole in the supporting material 32. It is preferred that there be three teeth 249 in driving engagement with the supporting material 32 at all times. The subframe sections 215 and 216 have respective aligned strippers 260 and 261 which facilitate disengagement of the teeth 249 with the supporting material 232 as the driver 244 rotates. Opposed guide grooves 262 and 263 formed in the subframe sections 215 and 216 guide the supporting material 32 to an exit opening 264. Excess supporting material which dangles from the apparatus 210 can be readily torn off at the exit opening 264.

With reference to FIG. 9, the print head 219 is shown by solid lines in the initial or home position and by phantom lines 219′ in the printing zone in printing cooperation with the label 36 and the platen 217. The operator 235 is shown by solid lines in its initial or home position and in phantom lines 235′ in the fully actuated position. In the fully actuated position, the print head 219 has been moved into printing cooperation with the labels 36 and the platen 217, and the operator 235 is in abutment with the stop block 239. In this position of the operator 235, the flexible resilient pawl 245 (FIG. 21), joined integrally at one end to the gear 243, has moved to the position shown by phantom lines 245′ in driving cooperation with a tooth 265 of the ratchet wheel 246. When the user releases the operator 235, the spring 238 (FIG. 9) returns the operator 235 against stop 239′ to the solid line position shown in FIG. 9. While the operator 235 is returning to the solid line position from the fully actuated position indicated by phantom lines 235′, the gear sections 240 and 241 (FIGS. 9 and 10) rotate gears 242 and 243 clockwise (FIG. 9) to return the print head 219 to the solid line position from the position shown by phantom lines 219′, and to drive the pawl 245 from the position shown by phantom lines 245′ to the position shown in solid lines in FIG. 21. Thus, the pawl 245, which is in engagement with a tooth 265, drives the ratchet wheel 246 counterclockwise (FIG. 21). This counterclockwise rotation of the ratchet wheel 246 (FIG. 21) causes the driver 244 to advance the supporting material 32 to effect substantially complete delamination of a label at the peel edge 218. Counterclockwise rotation of the ratchet wheel 246 continues until a pawl 266 (FIGS. 8, 13 and 21) in the form of a flexible resilient appendage of the subframe section 216, moves into engagement with a tooth 265 of the ratchet wheel. This prevents the web of supporting material 32 from being accidentally moved in the return direction.

As best shown in FIG. 10, the driver 244 has an annular rim 267 joined to a hub 268 by a radial web 269. The hub 268 has a hub section 268′ extending in one direction and another hub section 268″ extending in the opposite direction. The hub section 268′ terminates at a knob 270, and the hub section 268″ terminates at a knob 270′. The gear 242 is rotatably journaled on and with respect to the hub section 268′. The gear 242 has a hub or flange 271 which is rotatably journaled in opening 272 in the frame section 212. The hub section 268′ extends through an enlarged opening 273 in the subframe section 215. The hub section 268″ provides a stepped pair of bearing surfaces 274. The ratchet wheel 246 is formed integrally with the drive member 248 of the detent mechanism 247. The ratchet wheel 246 and the drive member 248 have a hub 276 with a stepped bore 275 into which the hub section 268″ extends. A hub 276 rotatably receives and mounts the gear 243. The gear 243 has a hub 277 rotatably received in a bearing 278 formed integrally with the housing section 213. As seen in FIG. 10, the gears 242 and 243 are in driving engagement with respective gear sections 224 and 225 carried by the print head 219; the relative position of the drive pawl 245 to the ratchet wheel 246 is also shown.

With reference to FIG. 21, the drive member 248 includes a plurality of spring fingers or detent pawls 278. The pawls 278 are of equal length, are flexible and resilient, and are continuously urged against teeth 279 formed on the inside of the annular rim 267. In the illustrated embodiment there are 127 teeth 279 at equally spaced-apart intervals. There are 12 pawls 278 integrally connected to the hub 276 at equally spaced-apart intervals. The teeth 279 comprise respective tooth faces 280 and a recess between adjacent tooth faces 280 in which the end of a pawl 278 can be received. The pawls 278 drive the feed wheel 244 in a driving direction (counterclockwise in FIG. 21) but can move in a non-driving direction (clockwise in FIG. 21) relative to the feed wheel 244 by manually operating the detent mechanism 247. Accordingly, every fifth pawl 278 is engaged with the face 280 of a tooth 279. The pawls 278 between every fifth set of pawls are out of engagement with their respective tooth faces 280 by different increments as best illustrated in FIG. 22. Normally, the pawls 278 hold the ratchet wheel 246 and the feed wheel or driver 244 in fixed relationship with respect to each other. With reference to FIG. 21, as the drive pawl 245 moves counterclockwise the ratchet wheel 246 is driven counterclockwise and the three pawls 278 which are in driving engagement with their respective tooth faces 280 will drive the feed wheel 244 counterclockwise. Accordingly, there is no relative rotation between the ratchet wheel 246 and the feed wheel 244. Should it be desired to change the position to which the labels are advanced by the feed wheel 244 upon actuation of the operator 235, the user will grasp the knobs 270 and 270' and will rotate the knob 270' counterclockwise (FIG. 8) relative to the knob 270. This will cause the input member 248 to rotate (counterclockwise in FIG. 8, clockwise in FIG. 21) relative to the feed wheel 244 so that the next three successive teeth move into engagement with the next three respective tooth faces 280. For example, if it is considered that first, fifth and ninth pawls 278 were initially in engagement with respective teeth 279, only a very slight rotation will cause second, sixth and 10th pawls to move into engagement with their respective tooth faces 280, and so on. Although any desired number of pawls 278 and teeth 280 can be used, the illustrated embodiment provides very minute adjustment of the feed wheel 244 relative to the platen 217 and the peel edge 218 and the arrangement of teeth 280 and cooperating pawls 278 causes the entire input or drive member 248 to be centered within the annular rim 267. With respect to the printing function, adjustment of the detent mechanism 247 changes the position relative to the printing zone between the print head 219 and the platen 217 to which a label 36 is advanced. With respect to the delaminating function, operation of the detent mechanism 247 also changes the position to which the label 36 is advanced. Accordingly, it is apparent that the detent mechanism 247 is useful both in establishing the position to which a label is advanced relative to the printing zone and to the delaminating zone. It is important that just the correct amount of trailing marginal end edge of the label remain adhered to the peel edge so that the label 36 is held in that position until it is ready to be applied to merchandise by the applicator 253.

As best shown in FIGS. 21, 23, and 24, the supporting material 32 is initially brought into engagement with the feed wheel 244 as it passes around the die wheel 259. The die wheel 259 is comprised of an annular plastic roll 281 journaled by subframe sections 215 and 216. The roll 281 has frictional members in the form of rubber O-rings 282 received at spaced-apart locations about the periphery of the roll 281. The O-rings straddle the teeth 249 and are just spaced apart far enough to act as a die wheel with mating teeth 249. As a tooth 249 begins to engage the web of supporting material 32 at the cut 39S (FIG. 2), the die wheel 259 cooperates with the tooth 249 to hold the supporting material 32 on each side of the group 38 of cuts in intimate contact with the outer surface of the feed wheel 244 as best shown in FIG. 24. This insures that the tooth 249 properly bursts or forms a hole, facilitated by the group 38 of cuts, in the supporting material 32 and that the drive face of the tooth 249 is in driving engagement with the leading cut 41S. When the first tooth 249 registers with the group 38 of cuts in the supporting material 32 the composite web 30 is properly registered with the printing zone and the delaminating zone. Once such registration is accomplished as the result of the tooth 249 cooperating with the die roll 259, correct registration continues.

The platen 217 and the peel edge 218 (FIGS. 8 and 9) are formed from an inversely-bent plate having a pair of side-by-side plate portions 283 and 284 joined by an inversely-bent portion 285. The inversely-bent portion 285 has a small radius and defines the peel edge 218. The plate portions 283 and 284 are co-extensive and are secured to each other by weldments 286. The plate which forms the platen 217 and the peel edge 218, received in recesses 286' in subframe sections 215 and 216, is preferably constructed of highly polished stainless steel. The sides of the plate that forms the platen 217 and the peel edge 218 are received in opposed recesses 286' in the subframe sections 215 and 216. A label stopper is provided by a pair of aligned plates 218' formed integrally with the subframe sections 215 and 216. The plates 218' are disposed beneath but are spaced from the plate 217. Should a label 36 attempt to fall onto the supporting material 32 after being delaminated at the peel edge 218, the labels 36 will be caught by the plates 218'. This will prevent any label 36 from continuing along the path through which the supporting material 32 passes after passing the peel edge 218.

With reference to FIG. 9, the stop block 239 is shown to be slidable on a stop surface 287. The stop block 239 has a threaded bore 288 which threadably receives an adjusted screw 289. One half of the screw 289 is rotatably received in a semi-circular groove 290 and one-half of the head 291 of the screw 289 is captive in a semi-circular recess 292 in the seat 293. The handle portion 233 of the frame section 212 provides another stop surface (not shown) for the stop block 239 in alignment with the stop surface 287, another semi-circular groove (not shown) opposite the groove 290 for receiving the other one-half of the screw 289, and another semi-circular recess (not shown) opposite the recess 292 for receiving the other one-half of the head 291. A hole 294, one-half of which is formed by each handle portion 233 and 234, enables entry of a tool (not shown) by which the head 291 of the screw 289 can be engaged to rotate the screw 289. Rotation of the screw in one direction will cause the stop block 239 to move upwardly (FIG. 9) and rotation of the screw 289 in the opposite direction will cause the stop block 239 to move downwardly (FIG. 9). It is apparent that adjustment of the position of the stop block 239 will adjust the limit of the travel of the operator 235.

With reference to FIG. 19, the inking mechanism 252 is shown to comprise a one-piece inker body 295 having an aligned pair of sockets 296 having converging openings 297. The sockets 296 extend for more than 180° so that the ink roll 298 can be snapped into the sockets 296. The inker body 295 has a pair of aligned projections 299 which are capable of being snapped into sockets 300 (FIG. 8) in the cover 251. The sockets 300 are shaped like the sockets 296. The inker body 295 has an integrally formed leaf spring or spring finger 301 which is shown in FIG. 20 to be urged against the cover 251. The spring finger 301 normally urges the inking mechanism 252 into the solid line position shown in FIG. 20. The ink roller 298 is shown in FIG. 20 to be in the path of but slightly spaced from the print head 219 because in that position the inker body 295 contacts the frame 221 of the print head 219. When the print head 219 is moved from the solid line position to the phantom line position, the ink roll 298 applies ink to the printing bands 220 and the entire inking mechanism 252 pivots about projections 299 to the position shown in phantom lines. When the print head 219 returns to the solid line position shown in FIG. 20, the spring finger 301 returns the inking mechanism 252 to the solid line position.

With reference to FIG. 19, the ink roller 298 is shown to comprise a pair of hub section 302 and 303. The hub section 302 has an elongated projection 304 at one end and a stub end 305 at its opposite end. The hub section 302 has an annular flange 306 between the stub end 305 and a reduced portion 307. The reduced portion 307 is disposed between the flange 306 and the projection 304. The other hub portion 303 has an annular flange 308 disposed between a reduced portion 309 and a stub end 310. The reduced portion 309 has a bore 304′ into which the projection 304 is adapted to be press-fitted. The projection 304 has straight flutes which serve to lock the hub portions 302 and 303 together. An ink-receptive tubular porous roll 311, composed for example of rubber or the like, is received on the reduced portions 307 and 309 of respective hub sections 302 and 303. The flanges 306 and 308 abut the ends of the roll 311 and prevent the roll 311 from shifting.

Figure 13:
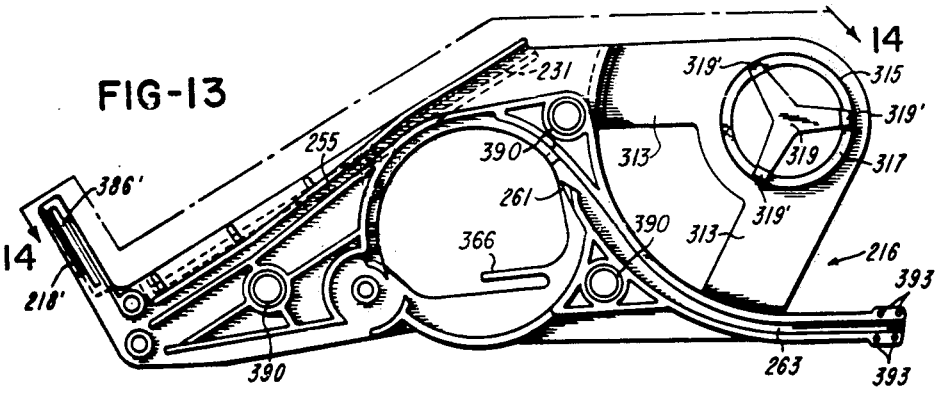
FIG. 13 is a side elevational view of one of the subframe sections of the apparatus.
Figure 14:
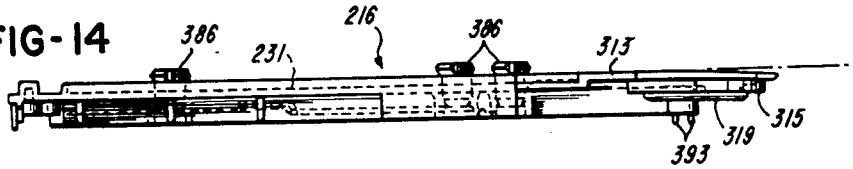
FIG. 14 is a top plan view taken along line 14—14 of FIG. 13.

With reference to FIGS. 13, 14 and 15, the subframe sections 215 and 216 are shown to have respective integral leaf springs 312 and 313. The leaf springs 312 and 313 are provided with integral annular brake members 314 and 315 having respective annular brake surfaces 316 and 317. Brake members 314 and 315 are formed integrally with projections or hubs 318 and 319, surfaces 318′ and 319′ of which are received in and mount label core 44. The brake surfaces 316 and 317 cooperate to exert braking forces on the label core 44. Neither the hubs 318 and 319 nor the brake members 314 and 315 contact the composite web 30 which is wound on the label core 44. In this manner, any gum or adhesive that may exist at the marginal side edges of the composite web 30 will not be transferred to the brake surfaces 316 and 317. FIG. 16 illustrates, in exaggerated form, by phantom lines, the initial positions of the leaf springs 312 and 313, the brake members 314 and 315 and the hubs 318 and 319. The initial canted position of the leaf springs 313, the brake members 315 and the hub 319 relative to the remainder of the subframe section 216 is also shown in FIG. 14. Insertion of the label core 44 onto the hubs 318 and 319 will cause the leaf springs 312 and 313 to flex outwardly and the brake surfaces 316 and 317 will exert a predetermined braking force on the ends of the core 44. The braking force applied to the core 44 will insure that there is tension in the web 32 of supporting material from the label roll to the printing zone, to the peel edge 218, and to the toothed driver 244. As the pawl 266 (FIG. 21) prevents the reverse rotation of the driver 244, it is seen that the apparatus maintains a slight but desirable amount of tension on the web of supporting material 32 at all times.

The frame 211 comprises an essentially closed shell but the rear part provides an access opening 211′ through which a roll of labels can be inserted and a spent core 44 can be removed without even partial disassembly of the apparatus 210.

With reference to FIG. 12, the operator 235 is shown to pivot on the pin 237. It is preferred to pivot the operator 235 at the lower end of the handle 232 in that the user's strongest fingers, namely his index, middle and ring fingers engage the operator 235 at substantial distances from the pivot pin 237, while the user's relatively weak little finger is close to the pivot pin 237. The ends of the pin 237 are undercut as indicated respectively at 403 and 404. The ends 401 and 402 are received in sockets 405 and 406 in respective frame sections 212 and 213. The sockets 405 and 406 are comprised of respective flexible resilient fingers 407 and 408. The operator 235, as best shown in FIGS. 9 and 10, is shown to be generally U-shaped in section. Legs 409 and 410 are shown to be rotatably received about the pin 237. The spiral or torsion spring 238 is shown to be received on pin 237 between the legs 409 and 410.

It is preferred to mold the driver or feed wheel 244 of a material which incorporates a lubricant to diminish the amount of gum or adhesive that is transferred to the feed wheel 244 during use to prevent improper feeding. By incorporating the lubricant in the feed wheel 244 the surface of the feed wheel 244 has a low coefficient of friction. However, the teeth 249 are adequate to grip and drive the web 32. One specific material to be used to mold the feed wheel is an acetal resin combined with polytetrafluoroethylene lubricants. One such material is sold commercially under the name Thermocomp, Number KL-4030 by Liquid Nitrogen Processing Corporation, Malvern, Pa., U.S.A. The remainder of the apparatus in FIGS. 37 through 69 except for the platen 217, the ball bearings 228 and 229, the spring 238, and rubber printing bands 220, are composed of suitable lightweight moldable plastic materials, for example, acetal, acrylonitrile-butadiene-styrene, or the like, but the ink roll 311 is preferably constructed of porous vinyl. Accordingly, the apparatus is very light in weight, and easy and convenient to use with a minimum of fatigue.

Other embodiments and modifications of this invention will suggest themselves to those skilled in the art, and all such of these as come within the spirit of this invention are included within its scope as best defined by the appended claims.

I claim:

1. Web feeding apparatus, comprising: a feed wheel having a plurality of teeth for engaging and driving a web, a position varying mechanism comprising a driven member secured to the feed wheel and having a plurality of spaced apart teeth and a driving member having a plurality of pawls engageable with less than the total number of teeth, the pawls being urged against the teeth to normally prevent rotation of the driving member relative to the driven member in either the driving direction or the non-driving direction, means for manually rotating the driving member in the non-driving direction relative to the driven member, means for driving the driving member, the driving means comprising a pivotally-mounted manually operable operating lever pivotal in opposite directions, a drive gear carried by the operating lever, a driven gear driven by the drive gear, a drive pawl carried by the driven gear, and a ratchet wheel driven by the pawl upon rotation of the driven gear and the pawl in one direction, and means for drivingly coupling the ratchet wheel and the driving member of the position varying mechanism, the position varying mechanism being effective to vary the position of the ratchet wheel relative to the feed wheel.

2. Web feeding apparatus, comprising: a feed wheel for feeding a web, a position varying mechanism comprising a driven member secured to the feed wheel and having a plurality of spaced apart teeth and a driving member having a plurality of pawls engageable with less than the total number of teeth, the pawls being urged against the teeth to normally prevent rotation of the driving member relative to the driven member in either the driving direction or the non-driving direction, means including a ratchet and a cooperable pawl for driving the driving member, and means for manually rotating the driving member in the non-driving direction relative to the driven member to vary the position of the ratchet wheel relative to the feed wheel.

3. The combination as defined in claim 2, wherein the manual rotating means comprises a pair of manually graspable knobs.

4. The combination as defined in claim 2, wherein the feed wheel is of one-piece molded plastics construction and the teeth are molded integrally with the feed wheel.

5. The combination as defined in claim 2, wherein the driving means comprises an operating lever, a drive gear carried by the operating lever, and a driven gear driven by the drive gear, the pawl being carried by the drive gear.

6. Web feeding apparatus, comprising: a feed wheel for feeding a web, a position varying mechanism comprising a driven member secured to the feed wheel and having a plurality of spaced apart teeth and a driving member having a plurality of pawls engageable with less than the total number of teeth, the pawls being urged against the teeth to normally prevent rotation of the driving member relative to the driven member in either the driving direction or the non-driving direction, means for manually rotating the driving member in the non-driving direction relative to the driven member, and means including a driven gear for driving the driving member in the driving direction to drive the feed wheel.

7. The combination as defined in claim 1, wherein the manual rotating means comprises a pair of manually graspable knobs.

8. The combination as defined in claim 6, wherein the feed wheel is of one-piece molded plastics construction and the teeth are molded integrally with the feed wheel.

9. The combination as defined in claim 6, wherein the driving means comprises an operating lever, a drive gear carried by the operating lever, and means for drivingly coupling the driven gear and the position varying mechanism.

10. In combination, a feed wheel for feeding a web, a position varying mechanism comprising a driven member secured to the feed wheel and having a plurality of spaced apart teeth and a driving member having a plurality of pawls engageable with less than the total number of teeth, the pawls being urged against the teeth to normally prevent rotation of the driving member relative to the driven member in either the driving direction or the non-driving direction, means for manually rotating the driving member in the non-driving direction relative to the driven member, and means for driving the driving member in the driving direction to drive the feed wheel.

11. Web feeding apparatus, comprising: a feed wheel for feeding a web, means for driving the feed wheel comprising a ratchet wheel, a driven gear mounted coaxially with respect to the feed wheel, a pawl carried by the driven gear and cooperable with the ratchet wheel, a drive gear in driving engagement with the driven gear, and means for alternately rotating the drive gear in one direction and thereafter in the opposite direction, and means for varying the position of the ratchet wheel relative to the feed wheel, the position varying means including a plurality of teeth connected to the feed wheel, a hub connected to the ratchet wheel, and a plurality of other pawls connected to the hub and cooperable with the teeth, but the number of other pawls being fewer in number than the number of teeth, the disposition of the other pawls being such that in any one position of the hub less than all the other pawls cooperate with the teeth.

12. Web feeding apparatus, comprising: a feed wheel for feeding a web, means for driving the feed wheel comprising a ratchet wheel, a driven gear mounted coaxially with respect to the feed wheel, a pawl carried by the driven gear and cooperable with the ratchet wheel, a drive gear in driving engagement with the driven gear, and means for alternately rotating the drive gear in one direction and thereafter in the opposite direction, and means for varying the position of the ratchet wheel relative to the feed wheel, the position varying means including a plurality of teeth connected to the feed wheel, a hub connected to the ratchet wheel, a manually graspable knob connected to the hub, a plurality of other pawls connected to the hub and cooperable with the teeth, but the number of other pawls being fewer in number than the number of teeth, the disposition of the other pawls being such that in any one position of the hub less than all the other pawls cooperate with the teeth, and another manually graspable knob connected to the feed wheel, so that relative rotation of the knobs causes different ones of the other pawls to be moved into cooperation with the teeth.

13. Web feeding apparatus, comprising: a feed wheel for feeding a web, means for driving the feed wheel comprising a ratchet wheel, a driven gear mounted coaxially with respect to the feed wheel, a pawl carried by the driven gear and cooperable with the ratchet wheel, a drive gear in driving engagement with the driven gear, and means for alternately rotating the drive gear in one direction and thereafter in the opposite direction, and means for varying the position of the ratchet wheel relative to the feed wheel, the position varying means including a detent mechanism having relatively movable parts, and a pair of knobs connected to the parts of the detent mechanism by which relative movement between the parts and hence the variation of the position of the ratchet wheel relative to the feed wheel can be manually effected.

14. Web feeding apparatus comprising: a feed wheel for feeding a web, means for driving the feed wheel comprising a ratchet wheel, a driven gear mounted coaxially with respect to the feed wheel, a pawl carried by the driven gear and cooperable with the ratchet wheel, a drive gear in driving engagement with the driven gear, and means for alternately rotating the drive gear in one direction and thereafter in the opposite direction, and means for varying the position of the ratchet wheel relative to the feed wheel, the position varying means comprising means coupling the ratchet wheel and the feed wheel and including a plurality of teeth providing for variation of the positioning of the ratchet wheel with respect to the feed wheel.

15. Web feeding apparatus, comprising: a feed wheel for feeding a web, means for driving the feed wheel comprising a ratchet wheel, a driven gear mounted coaxially with respect to the feed wheel, a pawl carried by the driven gear and cooperable with the ratchet wheel, a drive gear in driving engagement with the driven gear, and means for alternately rotating the drive gear in one direction and thereafter in the opposite direction, and means for varying the position of the ratchet wheel with respect to the feed wheel, the position varying means comprising settable parts, the ratchet wheel and one of the parts being comprised of one-piece molded plastics material and the feed wheel and another of the parts being constructed of one-piece molded plastics material.

16. Web feeding apparatus as defined in claim 15, wherein the pawl is molded integrally with the driven gear.

* * * * *